US010292461B2

(12) United States Patent
Jin

(10) Patent No.: US 10,292,461 B2
(45) Date of Patent: May 21, 2019

(54) SLIDE FASTENER

(71) Applicant: KMK CO., LTD, Namyangju-si, Gyeonggi-do (KR)

(72) Inventor: Jung Pil Jin, Namyangju-si (KR)

(73) Assignee: KMK CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/543,067

(22) PCT Filed: Dec. 16, 2015

(86) PCT No.: PCT/KR2015/013810
§ 371 (c)(1),
(2) Date: Jul. 12, 2017

(87) PCT Pub. No.: WO2016/114502
PCT Pub. Date: Jul. 21, 2016

(65) Prior Publication Data

US 2018/0000203 A1 Jan. 4, 2018

(30) Foreign Application Priority Data

Jan. 12, 2015 (KR) ..... 10-2015-0004049
Jun. 15, 2015 (WO) ..... PCT/KR2015/005983
Dec. 16, 2015 (KR) ..... 10-2015-0179731

(51) Int. Cl.
*A44B 19/04* (2006.01)
*A44B 19/24* (2006.01)
(Continued)

(52) U.S. Cl.
CPC ..... *A44B 19/04* (2013.01); *A44B 19/24* (2013.01); *A44B 19/28* (2013.01); *A44B 19/388* (2013.01);
(Continued)

(58) Field of Classification Search
CPC ..... A44B 19/04; A44B 19/24; A44B 19/388; A44B 19/28; A44B 19/262; A44D 2203/00
See application file for complete search history.

(56) References Cited

U.S. PATENT DOCUMENTS 4,139,927 A * 2/1979 Heimberger ..... A44B 19/38 24/434
4,232,429 A * 11/1980 Friedberg ..... A44B 19/38 24/388
(Continued)

FOREIGN PATENT DOCUMENTS

JP 2004-248809 9/2004
JP 5509382 B1 3/2014
(Continued)

OTHER PUBLICATIONS

International Search Report issued in International Application No. PCT/KR2015/013810, dated May 25, 2016.
(Continued)

*Primary Examiner* — Robert Sandy
*Assistant Examiner* — David M Upchurch
(74) *Attorney, Agent, or Firm* — Charles C. Achkar; Ostrolenk Faber LLP.

(57) ABSTRACT

A slide fastener of the present invention includes: a first fastener stringer; a second fastener stringer; and a slider which couples or separates the first and second fastener stringers, in which the second fastener stringer separated from the slider is inserted into the slider wherein the first fastener stringer and the second fastener stringer are coupled in a vertical direction. Accordingly, a row of fastener elements of the second fastener stringer separated from the slider is inserted into the slider by first and second fastening members when a fixing pin and an insertion pin are coupled
(Continued)

in a vertical direction, and as a result, the coupling operation is convenient.

10 Claims, 10 Drawing Sheets

(51) Int. Cl.
*A44B 19/38* (2006.01)
*A44B 19/26* (2006.01)
*A44B 19/30* (2006.01)
*A44B 19/28* (2006.01)

(52) U.S. Cl.
CPC ..... *A44B 19/262* (2013.01); *A44B 19/306* (2013.01); *A44D 2203/00* (2013.01)

(56) References Cited

U.S. PATENT DOCUMENTS 4,326,319 A * 4/1982 Friedberg ..... A44B 19/38 24/386
5,396,685 A * 3/1995 Wilk ..... A44B 19/38 24/388
5,608,952 A * 3/1997 Wilder ..... A44B 19/388 24/433
6,088,888 A * 7/2000 Oda ..... A44B 19/38 24/433
6,421,887 B1 * 7/2002 Oda ..... A44B 19/38 24/433
6,510,595 B2 * 1/2003 Matsushima ..... A44B 19/388 24/399
6,604,262 B2 * 8/2003 Wang ..... A44B 19/14 24/388
7,036,192 B2 5/2006 Yoneoka
8,806,725 B2 8/2014 Keyaki et al.
9,027,210 B2 5/2015 Keiichi
2003/0213106 A1 * 11/2003 Ichikawa ..... A44B 19/388 24/433
2005/0050699 A1 * 3/2005 Yoneoka ..... A44B 19/38 24/433
2013/0061436 A1 * 3/2013 Peters ..... A44B 99/00 24/430

FOREIGN PATENT DOCUMENTS

KR 10-2011-0079753 A 7/2011
KR 10-2012-0014213 A 2/2012
KR 10-2014-0060356 A 5/2014

OTHER PUBLICATIONS

Written Opinion of the International Searching Authority issued in International Application No. PCT/KR2015/013810, dated May 25, 2016.

* cited by examiner

[Fig. 1]
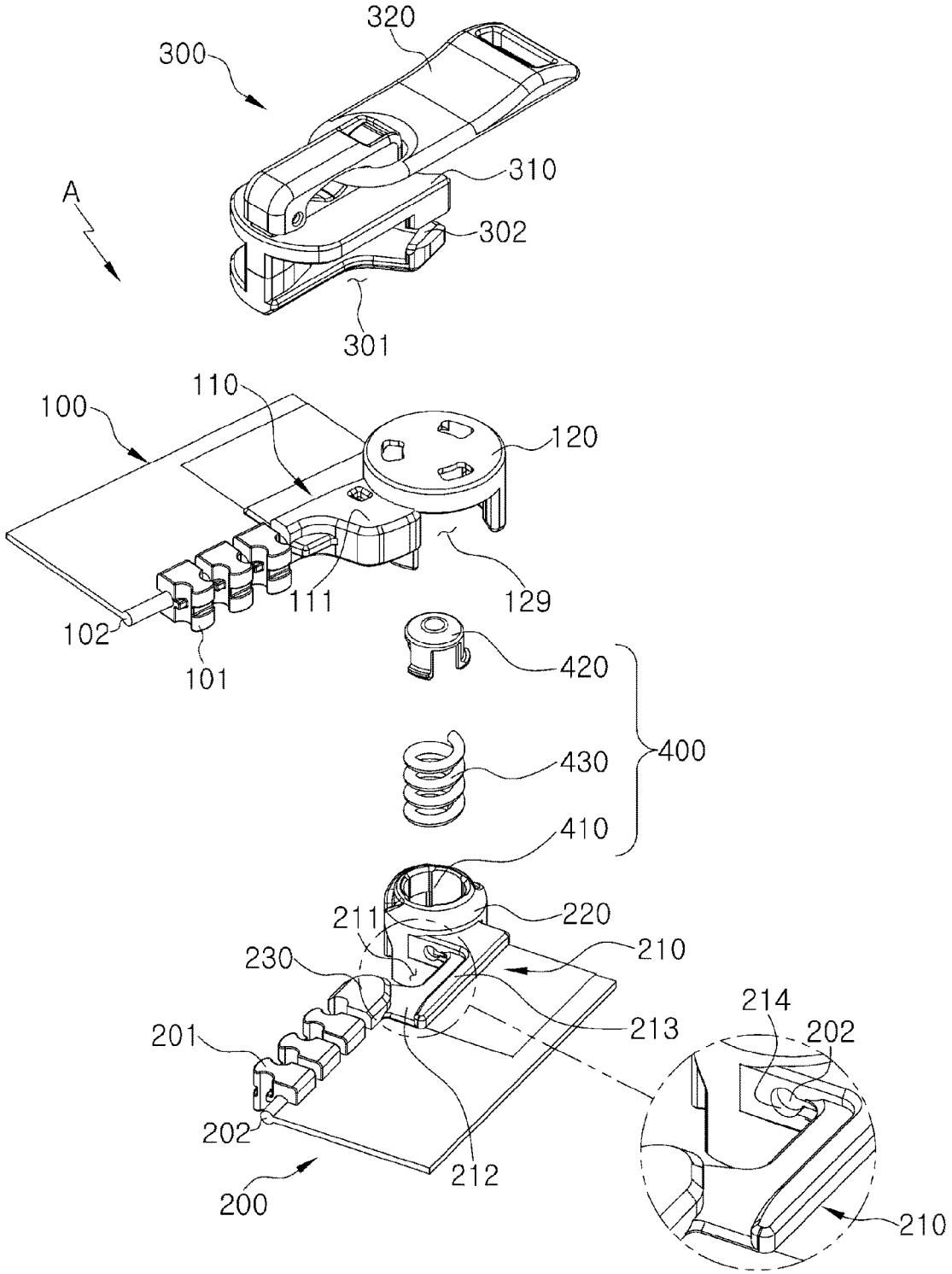

[Fig. 2]
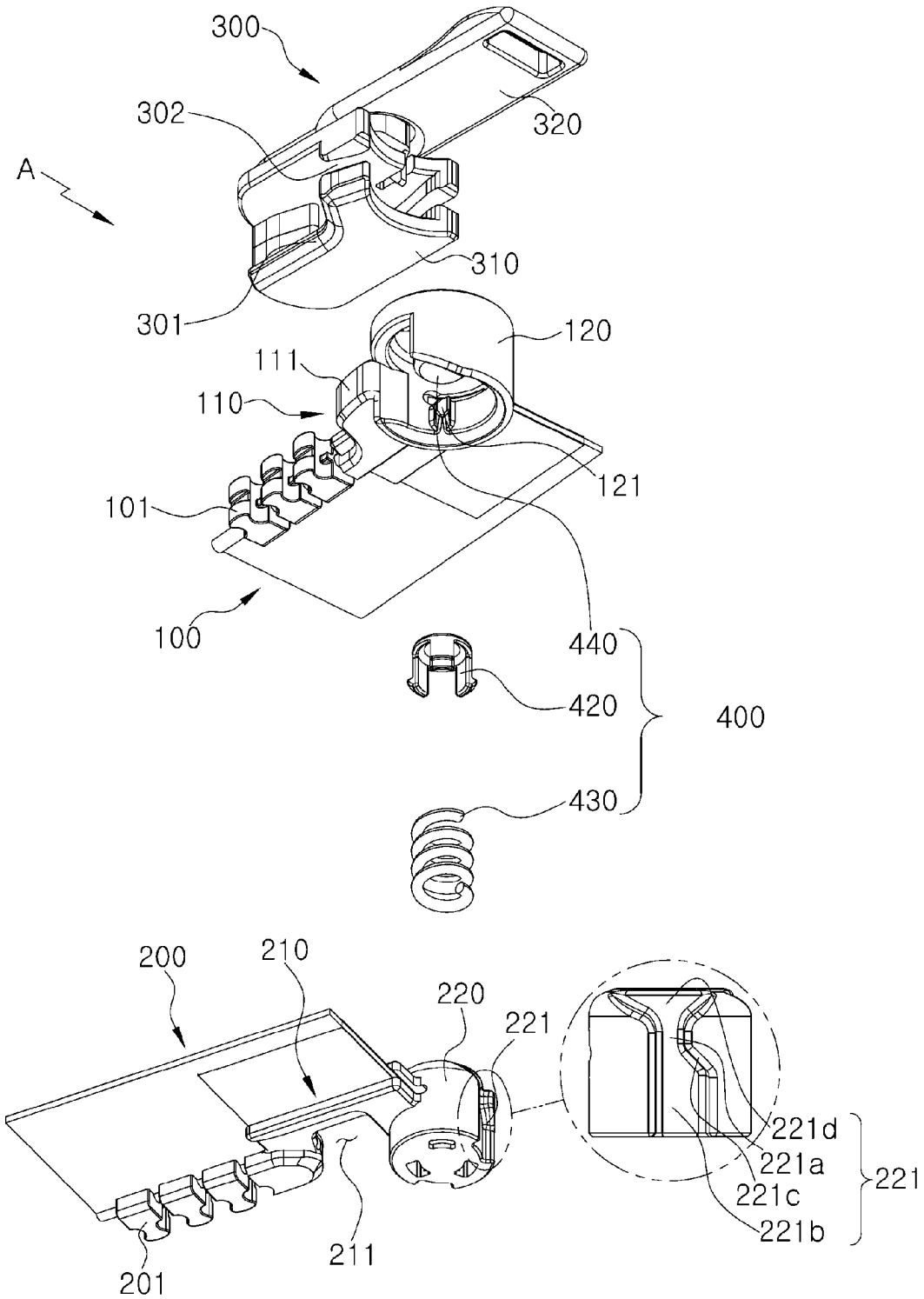

[Fig. 3]
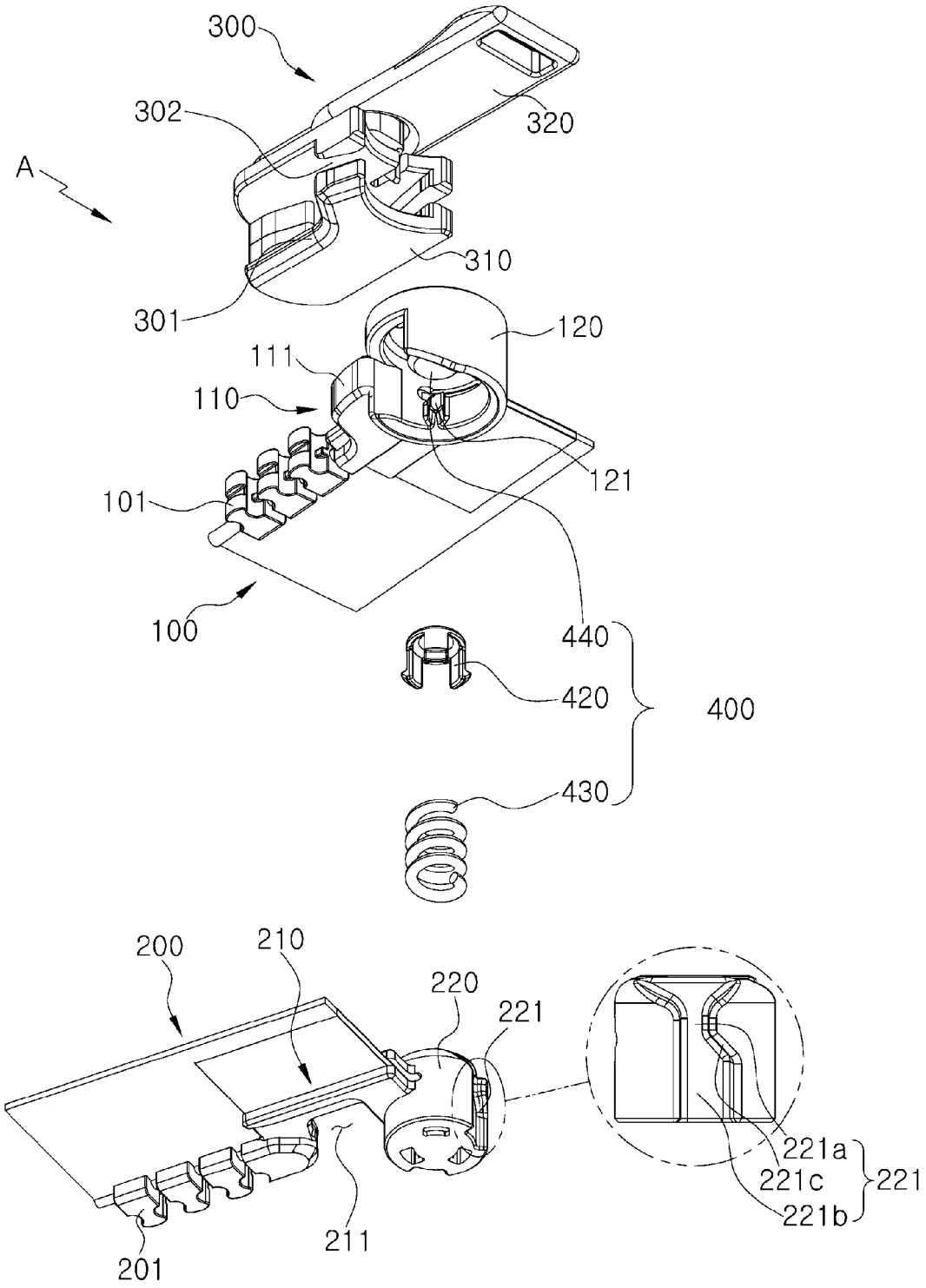

[Fig. 4]
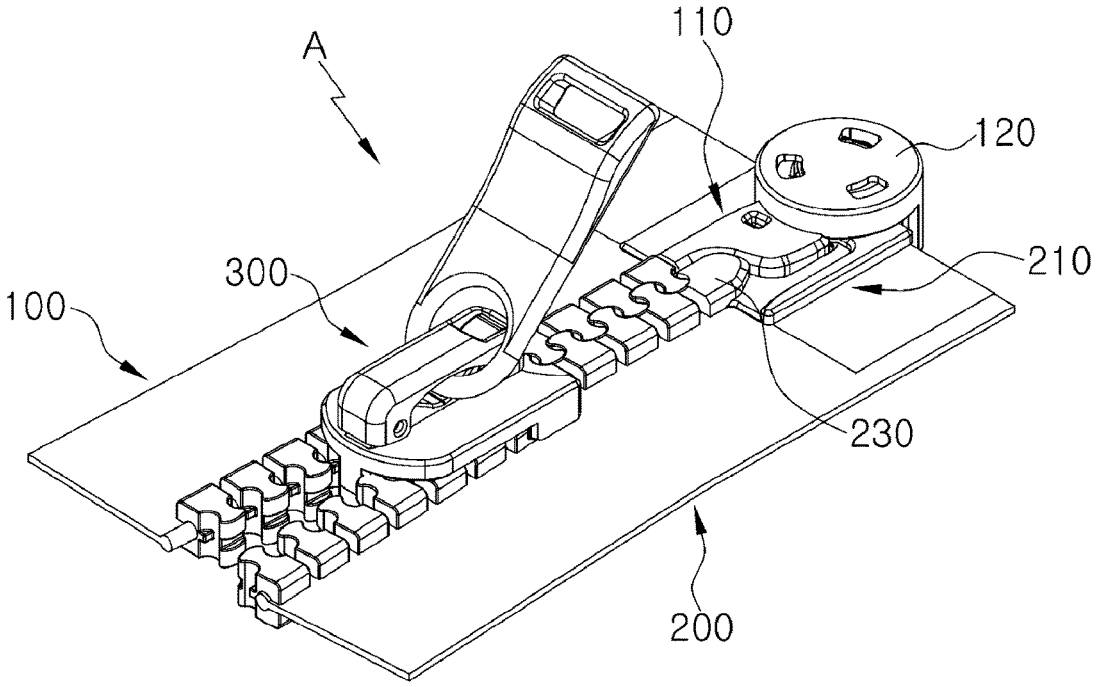

[Fig. 5]
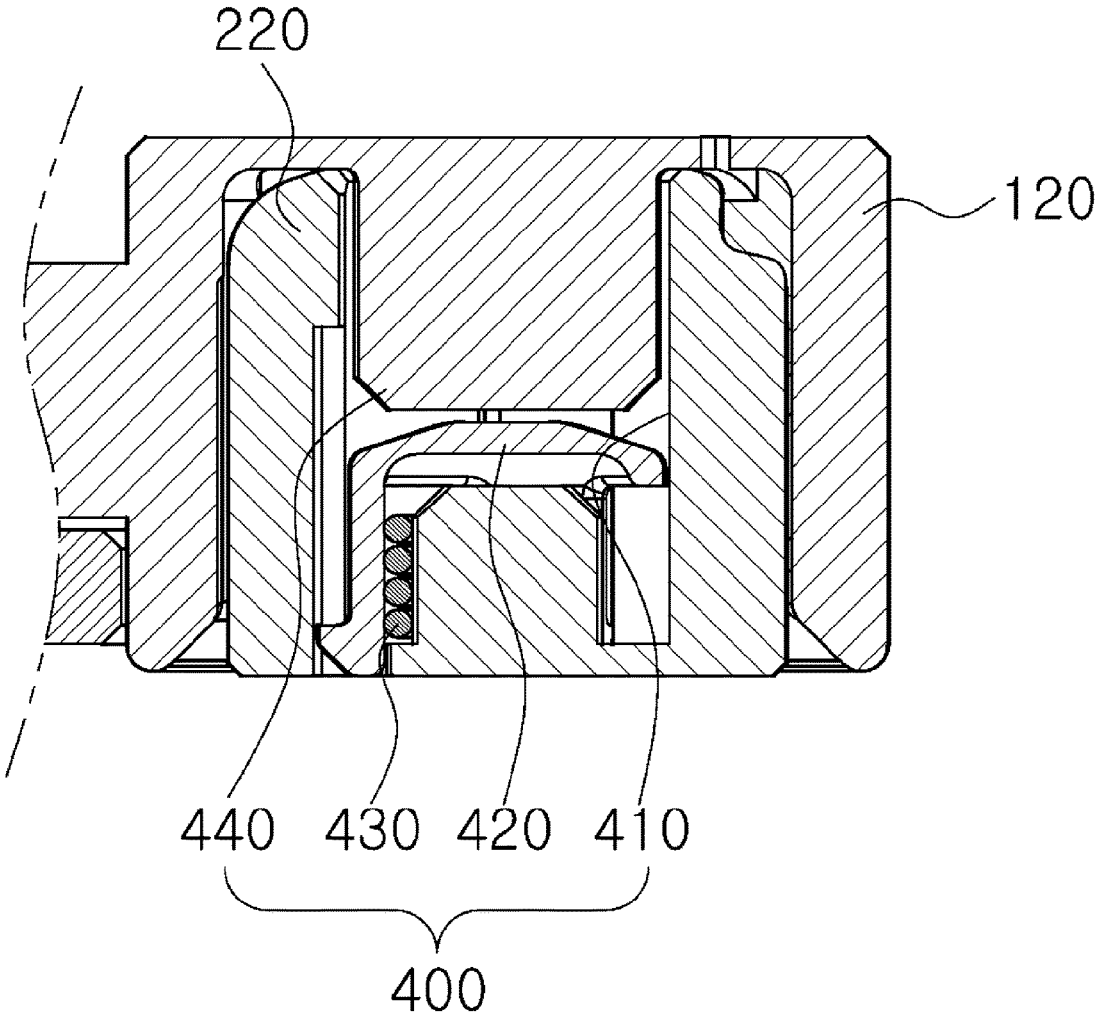

[Fig. 6]
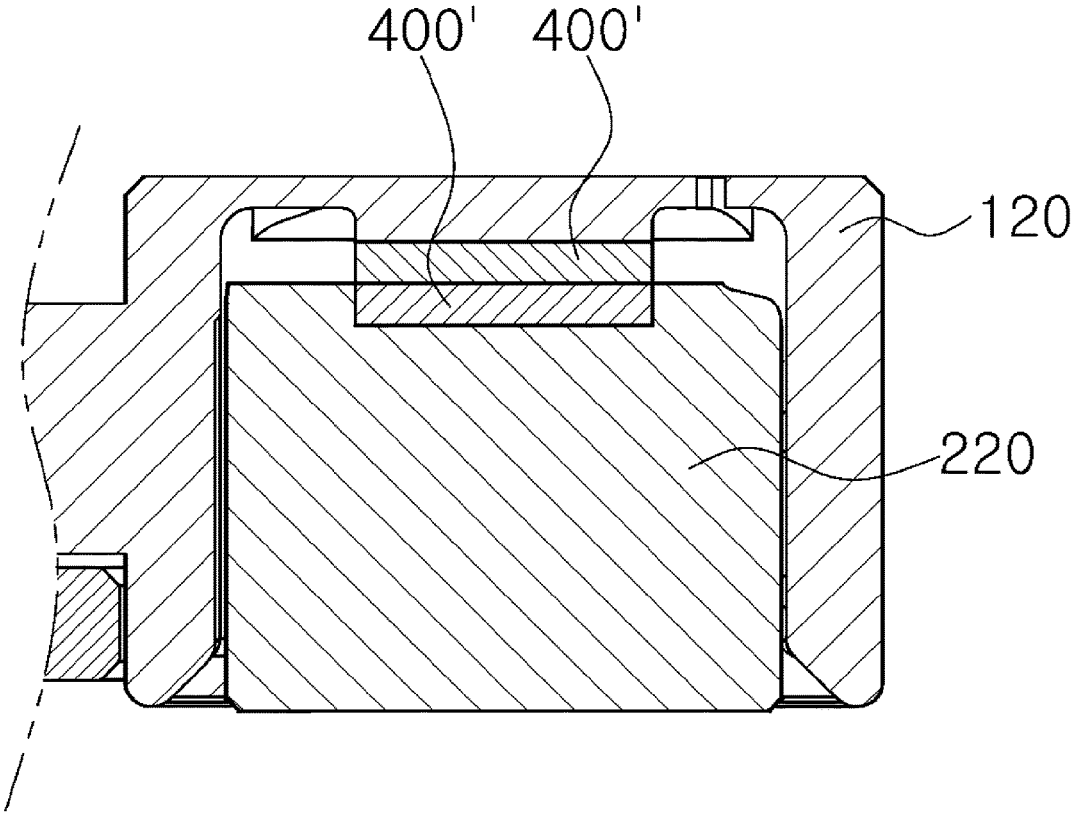

[Fig. 7]
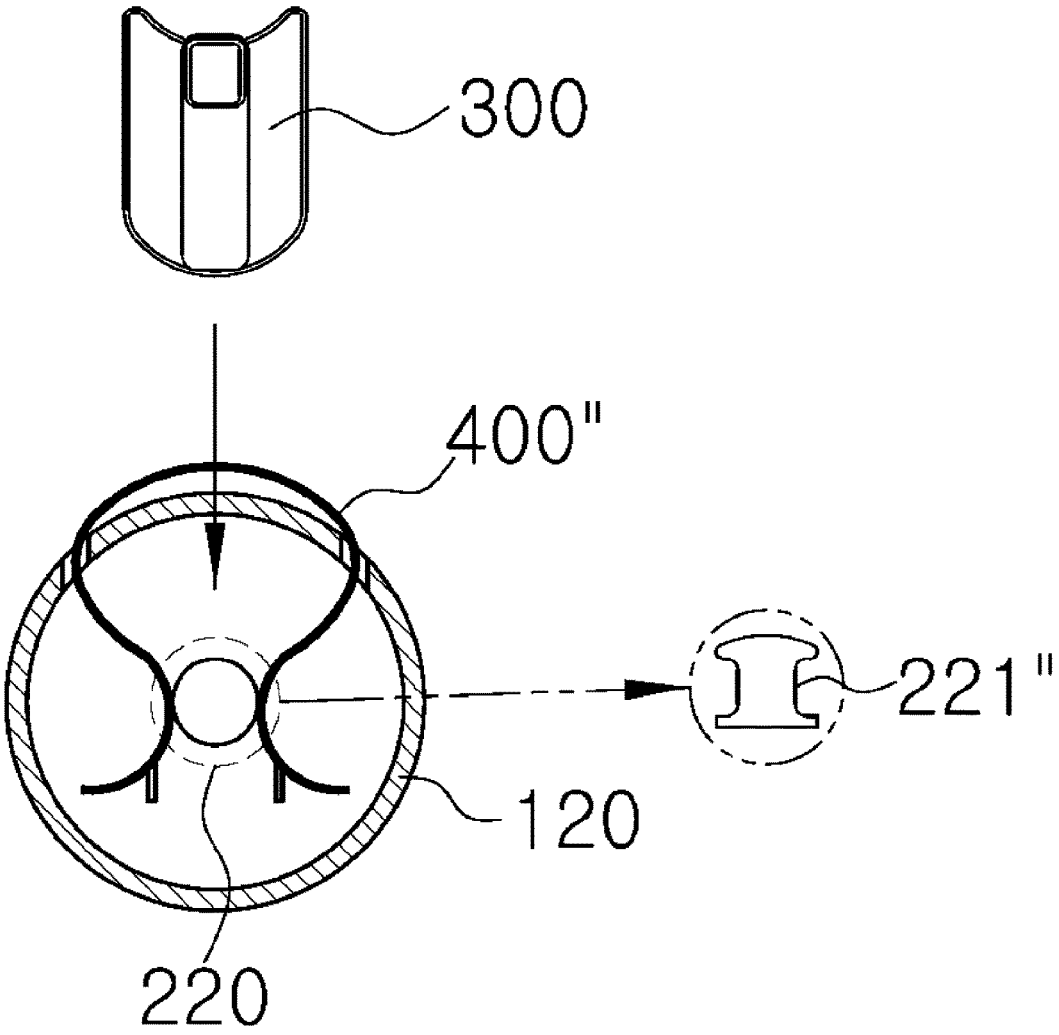

[Fig. 8]
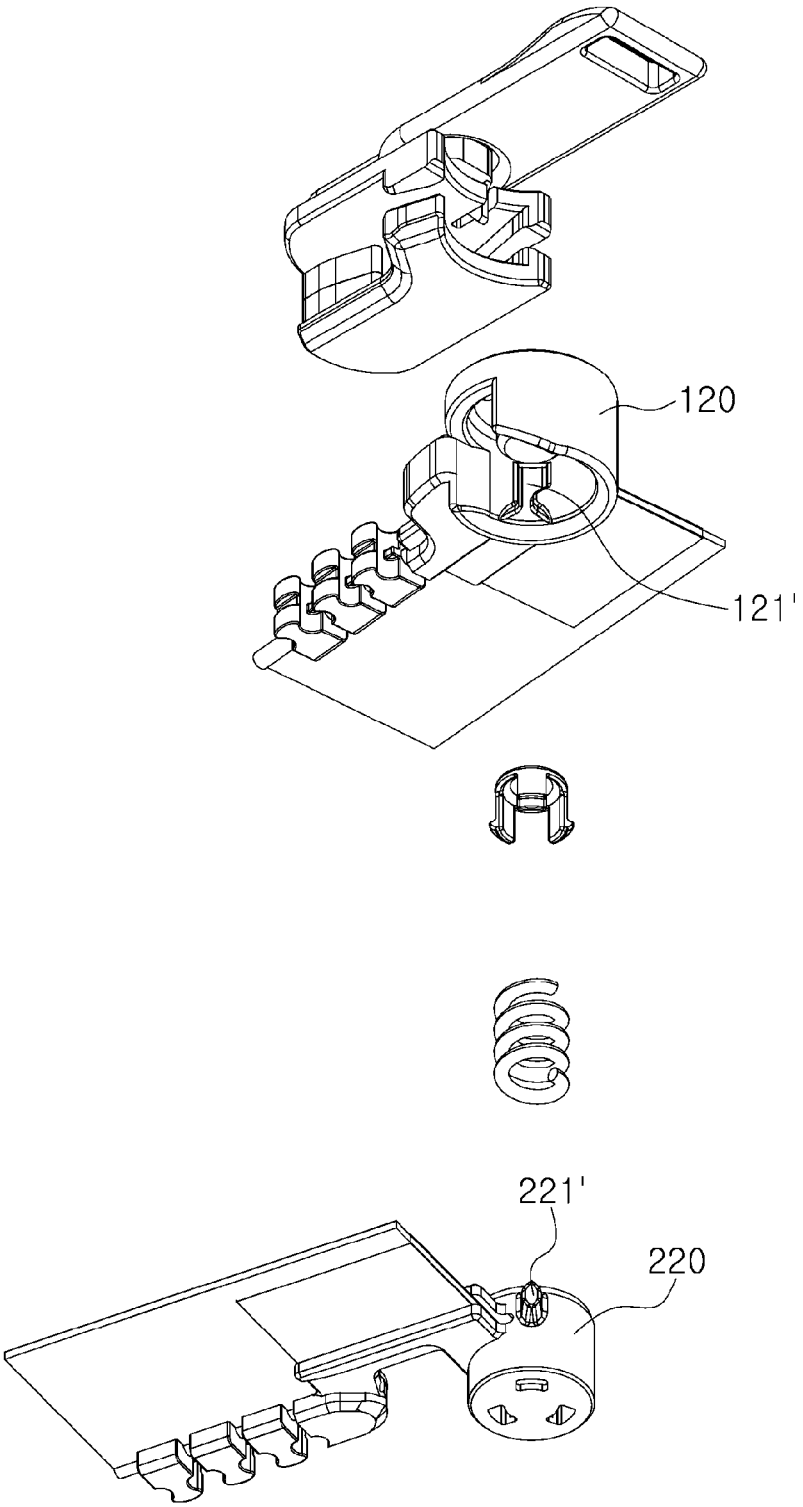

[Fig. 9]
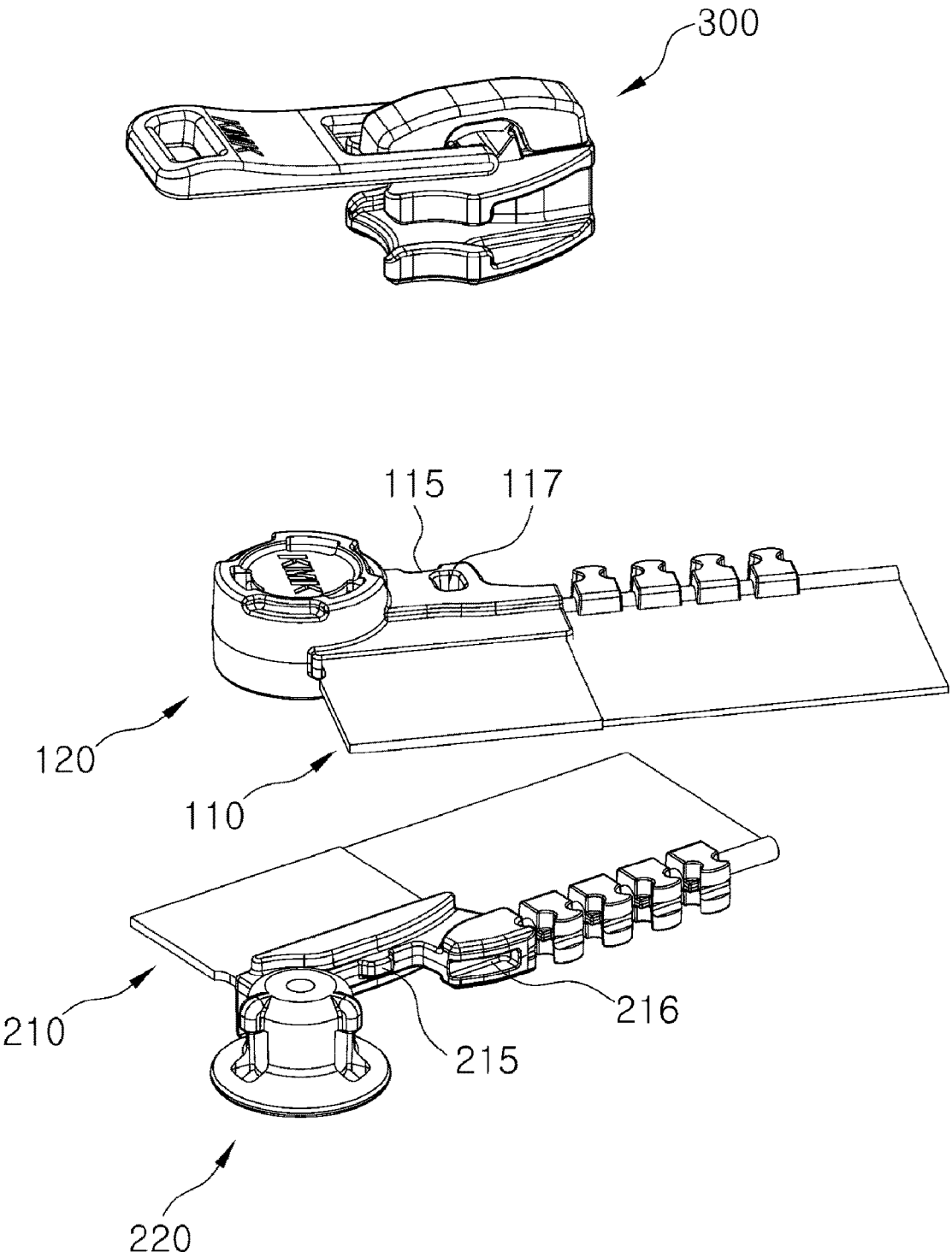

[Fig. 10]
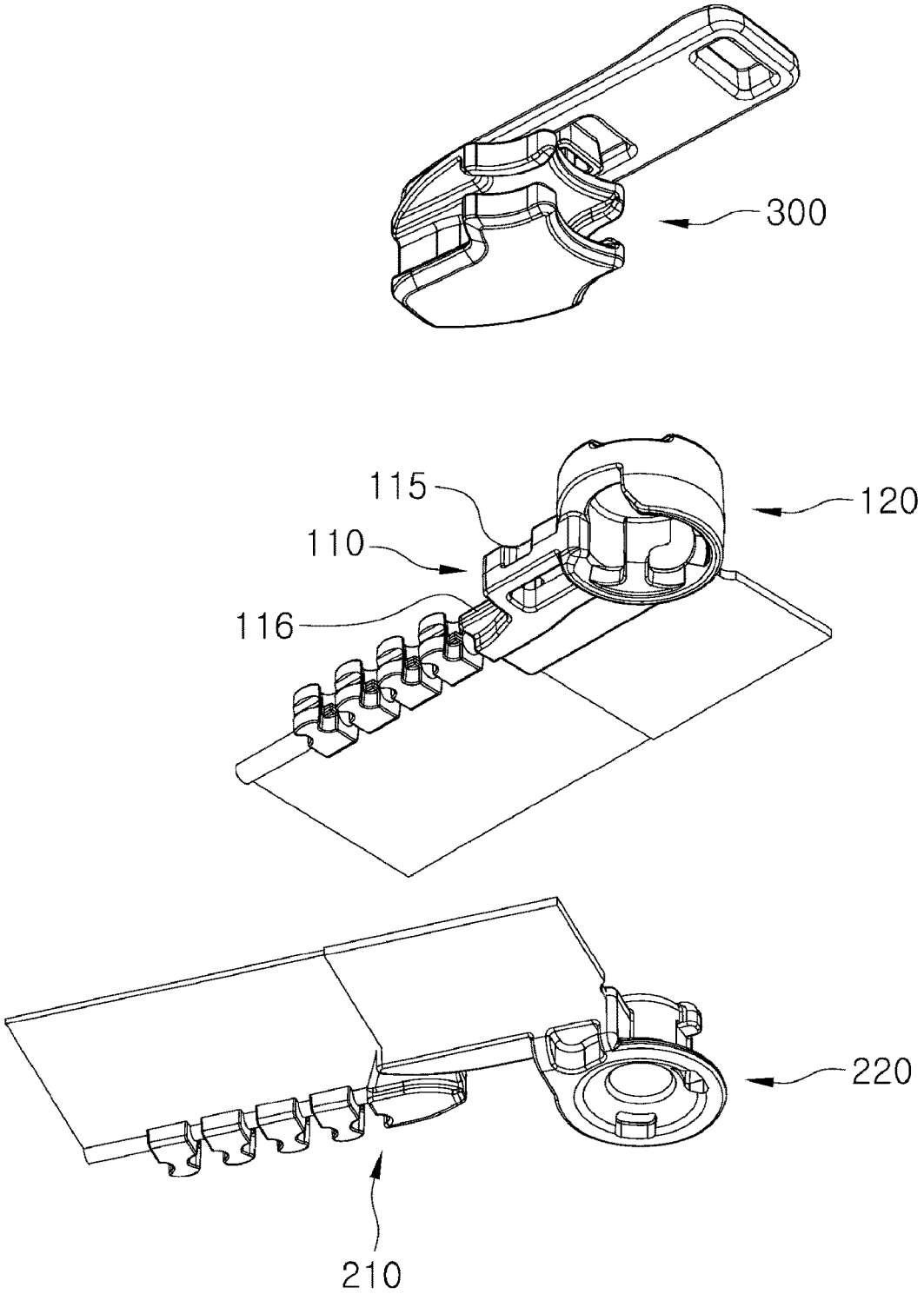

SLIDE FASTENER

CROSS REFERENCE TO RELATED APPLICATIONS

The present application is a § 371 National Phase application based on PCT/KR2015/013810 filed Dec. 16, 2015, which claims the benefit of Korean Patent Application No. 10-2015-0004049 filed Jan. 12, 2015 and PCT International Patent Application No. PCT/KR2015/005983 filed Jun. 15, 2015 and Korean Patent Application No. 10-2015-0179731, filed Dec. 16, 2015 the subject matter of each of which are incorporated by reference in their entirety.

TECHNICAL FIELD

The present invention relates to a slide fastener, and more particularly, to a slide fastener having a pair of fastener stringers that is easily coupled and separated.

BACKGROUND ART

In general, a slide fastener is attached to a bag or a garment and used to open and close an opening, and the slide fastener is widely used because the method of using the slide fastener is very convenient.

A structure of a slide fastener in the related art will be briefly described. For example, the slide fastener includes left and right fastener stringers which have rows of fastener elements that are continuously provided on a fastener tape in a coil or zigzag shape.

The row of fastener elements include the plurality of fastener elements, and the fastener elements are injection-molded at a rim of the fastener tape by using synthetic resin such as, for example, polyamide, polyacetal, polypropylene, and polybutylene terephthalate.

In addition, the slide fastener further includes a slider which separates or couples the left and right fastener stringers.

Therefore, when the slider moves forward, the row of fastener elements enters the slider through a front side of the slider, and engages with one another in the slider, and then exits the slider through a rear side. On the contrary, when the slider moves rearward, the row of the fastener elements, which engages with one another, is separated, and then exits the slider through the opposite side.

However, the publicly known slide fastener has a problem in that a preliminary operation of coupling the pair of left and right fastener stringers in advance is complicated.

Specifically, to fasten the slide fastener, it is necessary to perform an operation of inserting an insertion pin of the left fastener stringer, which is not coupled to the slider, into the slider through the front side of the slider and then coupling the insertion pin to a box after allowing the insertion pin to pass through the slider. However, there is a problem in that it is difficult to insert the insertion pin into the slider, for example, in a case in which a user wears gloves or the like.

In particular, it is more difficult for a child to fasten the slide fastener by him/herself because he/she cannot perform a delicate operation of inserting the insertion pin into the slider.

Furthermore, even in a case in which a protector fastens the slide fastener attached to the child's garment, it is difficult for the protector to fasten the slide fastener because the child moves a lot.

To solve the aforementioned problems, Patent Document 1 discloses a structure which includes a first terminal formed with locking elements, and a second terminal coupled to the first terminal by being rotated in a state in which the second terminal is fitted with the first terminal However, in the case of the structure, the second terminal is formed in a container shape and coupled to the first terminal by being rotated in a state in which the first terminal is accommodated in the second terminal, and as a result, there is an inconvenience of having to continuously perform two operations to couple the first and second terminals.

Furthermore, there is a problem in that the two operations need to be continuously performed to separate the first terminal and the second terminal.

In addition, because a stringer of a slider fastener is flexible, the second terminal and the slider easily interfere with each other when the slider is moved downward, and as a result, there is a problem in that it is difficult to accurately accommodate the slider in the second terminal.

Furthermore, because coupling force between a guide segment and the stringer is weak, there is a problem in that the second terminal is separated from the stringer during use.

Moreover, there is a problem in that the locking element is easily withdrawn from a notch while rotating, and the engagement of the row of fastener elements is released.

Further, because the container shape is opened, foreign substances can be easily introduced, and the locking element is more easily withdrawn from the notch due to an obstacle.

Patent Document 2 discloses a new structure in which a first fastening member and a second fastening member are vertically coupled and then horizontally rotated such that an insertion pin is inserted into a channel of a slider.

However, in Patent Document 2, a user needs to sequentially perform a vertical coupling operation, a horizontal rotating operation, and an operation of moving the slider in order to fasten a pair of fastener stringers, and the user needs to sequentially perform an operation of moving the slider downward, a horizontal rotating operation, and a vertical releasing operation in order to release the pair of fastener stringers, and as a result, the fastening and releasing operations are much more complicated than those for the existing slide fastener.

Furthermore, an operation of accurately rotating and inserting an insertion pin into a narrow channel of the slider in order to fasten a pair of fastener stringers is as difficult as the insertion operation of the existing slide fastener.

In addition, Patent Document 3 discloses a structure in which the slider is automatically rotated by an inclination angle when the slider is moved rearward in order to eliminate the horizontal rotating operation performed to release the pair of fastener stringers of Patent Document 2.

However, Patent Document 3 cannot sufficiently solve the drawback of Patent Document 2 because a vertical coupling operation, a horizontal rotating operation, and an operation of moving the slider upward need to be sequentially performed to fasten the pair of fastener stringers, and an operation of moving the slider downward and a vertical releasing operation need to be sequentially performed to release the pair of fastener stringers.

Therefore, there is a need for the development of a slide fastener capable of enabling a pair of left and right fastener stringers to be separated and coupled by a simple operation and improving coupling force with a stringer.

(Patent Document 1) U.S. Pat. No. 4,326,319 (Apr. 27, 1982)

(Patent Document 2) U.S. Pat. No. 4,139,927 (Feb. 20, 1979)

(Patent Document 3) Korean Patent No. 10-0281301 (Nov. 16, 2000)

DISCLOSURE

Technical Problem

The present invention has been made in an effort to solve the aforementioned various problems in the related art, and an object of the present invention is to provide a slide fastener which has a pair of fastener stringers that may be easily coupled or separated.

Technical Solution

To achieve the aforementioned object, a slide fastener of the present invention includes: a first fastener stringer; a second fastener stringer; and a slider which couples or separates the first and second fastener stringers, in which the second fastener stringer separated from the slider is inserted into the slider wherein the first fastener stringer and the second fastener stringer are coupled in a vertical direction.

In addition, the first fastener stringer may have a fixing pin, the second fastener stringer may have an insertion pin, and a row of fastener elements formed on the second fastener stringer may be inserted into the slider when the fixing pin and the insertion pin are coupled in the vertical direction.

In addition, the slide fastener may further include: a first fastening member which is provided on the fixing pin; and a second fastening member which is provided on the insertion pin and coupled to the first fastening member with directionality.

In addition, a guide protrusion may be formed on one of the first fastening member and the second fastening member, and a guide groove, which corresponds to the guide protrusion, may be formed in the other of the first fastening member and the second fastening member, which does not have the guide protrusion.

In addition, the guide groove may be divided into a first section, a second section which is relatively wider than the first section, and an inclined surface between the first section and the second section.

In addition, a guide surface, which guides the insertion of the guide protrusion, may be formed in an inlet of the first section.

In addition, the second fastener stringer may have an insertion member, and the slider may have a channel into which the insertion member is inserted, and a leading portion which is cut out to guide the insertion member to the channel.

In addition, a distance between the insertion member and the second fastening member may be equal to or greater than a length of the channel.

In addition, the slide fastener may further include an elastic means which automatically separates the second fastening member from the first fastening member.

In addition, the elastic means may include: an accommodating groove formed in the second fastening member; a push rod inserted into the accommodating groove; and a spring interposed between the accommodating groove and the push rod.

In addition, the insertion pin may have a fitting groove, and the fixing pin may have a fitting protrusion inserted into the fitting groove.

In addition, at least one of the first and second fastening members may include a magnet.

In addition, the second fastening member may have a catching projection inserted into the first fastening member, the first fastening member may have an omega shaped spring corresponding to the catching projection, and a part of the omega shaped spring may protrude toward the slider.

In addition, the insertion pin may have a fastening groove that surrounds a core yarn formed on the second fastener stringer.

Advantageous Effects

According to the slide fastener of the present invention, a row of the fastener elements of the second fastener stringer separated from the slider is inserted into the slider by the first and second fastening members when the fixing pin and the insertion pin are coupled in a vertical direction, and as a result, the coupling operation is convenient.

That is, the pair of first and second fastener stringers may be coupled to each other in the vertical direction, and then may be quickly coupled to each other by the slider.

Therefore, the insertion pin may be easily connected to the slider even in a state in which a user wears gloves or the like for example.

In addition, even a child may easily fasten the slide fastener without performing a delicate operation, and a protector may easily fasten the slide fastener of the garment of the child who is moving a lot, thereby improving convenience.

In addition, the insertion member is guided to the interior of the slider by the guide protrusion that moves along the guide groove.

In addition, the insertion pin (second fastening member) may be rotated only in the second section of the guide groove, it is possible to basically prevent the problem of Patent Document 1 that the row of fastener elements is released.

In addition, the first and second fastener stringers are automatically separated by the elastic means. That is, the first and second fastener stringers are separated as elastic restoring force of the spring included in the elastic means is transmitted to the pressing member through the push rod.

That is, when the user moves the slider downward to the lower ends of the first and second fastener stringers, the first and second fastener stringers are automatically separated. In the related art, an operation of moving a slider to a lower end of a fastener stringer and then separating an insertion pin from the slider is separately performed. However, in the present invention, only the operation of moving the slider downward is performed to separate the slide fastener.

In addition, the leading portion formed on the slider prevents interference the vertical movement of the second fastener stringer.

Therefore, according to the present invention, the pair of fastener stringers is fastened only by the vertical coupling operation and the operation of moving the slider upward, and the pair of fastener stringers is released only by the operation of moving slider downward, such that the vertical coupling method, which is more convenient than an vertical coupling method of the existing zipper is implemented, and as a result, convenience for the user is innovatively improved.

In addition, since the fastening groove surrounds the core yarn formed on the second fastener stringer, the insertion pin is prevented from being separated from the second fastener stringer.

That is, coupling force of the fastened portion between the insertion pin and the second fastener stringer, which receives a relatively large amount of stress when the first and second fastener stringers are fastened or separated, is improved.

DESCRIPTION OF DRAWINGS

FIG. 1 is an exploded perspective view illustrating a slide fastener according to a first exemplary embodiment of the present invention.

FIG. 2 is an exploded bottom perspective view illustrating the slide fastener according to the first exemplary embodiment of the present invention.

FIGS. 3 and 4 are perspective views illustrating a coupling state in FIG. 1.

FIG. 5 is a cross-sectional front view illustrating first and second fastening members.

FIG. 6 is a cross-sectional front view illustrating a slide fastener according to a second exemplary embodiment of the present invention.

FIG. 7 is a cross-sectional plan view illustrating a slide fastener according to a third exemplary embodiment of the present invention.

FIG. 8 is a bottom perspective view illustrating another exemplary embodiment of the first and second fastening members in FIG. 2.

FIGS. 9 and 10 are exploded perspective views illustrating a slide fastener according to a fourth exemplary embodiment of the present invention.

MODES OF THE INVENTION

Hereinafter, exemplary embodiments of the present invention will be described in detail with reference to the accompanying drawings.

First Exemplary Embodiment

FIG. 1 is an exploded perspective view illustrating a slide fastener according to a first exemplary embodiment of the present invention, FIG. 2 is a exploded bottom perspective view illustrating the slide fastener according to the first exemplary embodiment of the present invention, FIGS. 3 and 4 are perspective views illustrating a coupling state in FIG. 1, and FIG. 5 is a cross-sectional front view illustrating first and second fastening members.

As illustrated in FIGS. 1 to 5, a slide fastener A according to a first exemplary embodiment of the present invention includes first and second fastener stringers 100 and 200, and a slider 300 for coupling or separating the first and second fastener stringers 100 and 200.

The first and second fastener stringers 100 and 200 include a fastener tape, and rows of fastener elements including a plurality of fastener elements 101 and 201.

The fastener elements 101 and 201 are formed to surround core yarns 102 and 202 formed in the fastener tape, thereby preventing the separation between the fastener tape and the fastener elements 101 and 201.

A fixing pin 110 is provided on the first fastener stringer 100, and an insertion pin 210, which is inserted into the slider 300, is provided on the second fastener stringer 200.

The first fastener stringer 100 having the fixing pin 110 is a fixed fastener stringer that cannot be separated from the slider 300, and the second fastener stringer 200 having the insertion pin 210 is a separable fastener stringer that can be separated from the slider 300.

The slider 300 includes a main body 310 which may slide along the first and second fastener stringers 100 and 200, and a handle 320 which is installed on the main body 310 and held by a user.

Regarding main characteristics of the present invention, when the first fastener stringer 100 and the second fastener stringer 200 are coupled to each other in a vertical direction, the second fastener stringer 200 separated from the slider 300 is inserted into the slider 300, and specifically, the row of fastener elements 201 formed on the second fastener stringer 200 is inserted into the slider 300.

To this end, the fixing pin 110 has a first fastening member 120, and the insertion pin 210 has a second fastening member 220 which is coupled to the first fastening member 120 with directionality. The first fastening member 120 is formed in a cylinder shape, and the second fastening member 220 is accommodated in the first fastening member 120.

The first fastening member 120 may be formed in various shapes such as a circular cylinder shape, a circular cylinder shape with an opened upper side, and a hollow polygonal column shape, and the shape of the first fastening member 120 is not particularly limited as long as the first fastening member 120 may accommodate the second fastening member 220.

Furthermore, the second fastening member 220 may be formed to accommodate the first fastening member 120, and the shape of the second fastening member 220 is not particularly limited as long as the second fastening member 220 may accommodate the first fastening member 120.

In addition, an opening 129 is formed in the first fastening member 120 so that a connecting portion between the second fastening member 220 and the insertion pin 210 is inserted into the opening 129 while traversing the opening 129.

Further, a guide protrusion 121 is formed on an inner circumferential surface of the first fastening member 120, and a guide groove 221, which corresponds to the guide protrusion 121, is formed on an outer circumferential surface of the second fastening member 220. As illustrated in FIG. 8, a guide groove 121' may be formed in the first fastening member 120, and a guide protrusion 221' may be formed in the second fastening member 220.

That is, the second fastening member 220 is fastened to the first fastening member 120 with directionality by the guide protrusion 121 and the guide groove 221. Here, the directionality means a position where the row of fastener elements 201 of the second fastener stringer 200 separated from the slider 300 is inserted into the slider 300.

In this case, one or more pairs of guide protrusions 121 and guide grooves 221 may be formed.

Meanwhile, the guide groove 221 includes a first section 221*a*, and a second section 221*b* relatively wider than the first section 221*a*. An inclined surface 221*c* is formed between the first section 221*a* and the second section 221*b*, thereby guiding the movement of the guide protrusion 121.

That is, when the guide protrusion 121 is positioned in the first section 221*a*, a state in which the first and second fastener stringers 100 and 200 are spread at a predetermined angle is maintained, but the row of fastener elements 201 of the second fastener stringer 200 is inserted into the slider 300.

Furthermore, when the guide protrusion 121 is positioned in the second section 221*b*, an angle between the first and second fastener stringers 100 and 200 is decreased so that the fixing pin 110 and the insertion pin 210 face each other.

Moreover, when the slider 300 is moved forward, a wall of a channel 302 presses a lateral surface of an insertion member 230 to be described below, and the insertion pin 210 is rotated in a direction toward the fixing pin 110, such that the fixing pin 110 and the insertion pin 210 may face each other.

As a result, as the slider 300 is moved forward, the insertion pin 210 is automatically rotated in the direction toward the fixing pin.

Therefore, by the guide protrusion 121 moving along the guide groove 221, the row of fastener elements 201 of the second fastener stringer 200, that is, the insertion member 230 to be described below penetrates the interior of the slider 300, such that the row of fastener elements 101 of the first fastener stringer 100 and the row of fastener elements 201 of the second fastener stringer 200 are engaged with each other.

Meanwhile, a guide surface 221*d* for guiding the insertion of the guide protrusion 121 is formed at an inlet of the first section 221*a*. The guide surface 221*d* is formed to widen the inlet of the first section 221*a*, and as a result, the guide surface 221*d* guides the guide protrusion 121 to the first section 221*a*, that is, to the guide groove 221 even though the insertion direction of the guide protrusion 121 partially deviates from the first section 221*a*.

In addition, the second fastener stringer 200 has the insertion member 230, and the slider 300 has a leading portion 301 which is cut out to guide the insertion member 230 to the channel 302.

In this case, a distance between the insertion member 230 and the second fastening member 220 is equal to or greater than a length of the channel 302. That is, a minimum distance and a minimum space, through which the insertion member 230 may be inserted into the channel 302, are ensured.

Therefore, the insertion member 230 of the second fastener stringer 200 separated from the slider 300 is positioned to be inserted into the slider 300, that is, into the channel 302 by the first and second fastening members 120 and 220, the insertion member 230, and the leading portion 301, and as a result, the fixing pin 110 and the insertion pin 210 are easily coupled to each other when the fixing pin 110 and the insertion pin 210 are coupled to each other in the vertical direction.

That is, the pair of first and second fastener stringers 100 and 200 may be coupled to each other in the vertical direction, and then may be quickly coupled to each other by the slider 300.

As a result, the insertion pin 210 may be easily connected to the slider 300 even in a case in which the user wears gloves or the like for example.

In addition, even a child may easily fasten the slide fastener without performing a delicate operation, and a protector may easily fasten the slide fastener of the garment of the child who is moving a lot, thereby improving convenience.

In addition, an elastic means 400 is further provided to automatically separate the second fastening member 220 from the first fastening member 120 when the slider 300 is moved to a position where the first and second fastener stringers 100 and 200 are separated (i.e., a position where the insertion pin 210 is separated from the slider 300).

The elastic means 400 includes an accommodating groove 410 which is formed in the second fastening member 220, a push rod 420 which is inserted into the accommodating groove 410, a spring 430 which is interposed between the accommodating groove 410 and the push rod 420, and a pressing member 440 which is formed in the first fastening member 120 so as to correspond to the push rod 420.

That is, when the fastened state of the slide fastener is maintained by the engagement between the first and second fastener stringers 100 and 200, the pressing member 440 pushes the push rod 420, and a compressed state of the spring 430 is maintained. In this case, when the engagement between the first and second fastener stringers 100 and 200 is released, the compressed spring 430 applies elastic force to the push rod 420, and the push rod 420 pushes the pressing member 440, such that the second fastening member 220 exits the first fastening member 120.

Specifically, when the insertion member 230 is moved away from the channel 302 as the slider 300 is moved rearward, the push rod 420 pushes the pressing member 440 by elastic restoring force of the spring 430. The guide protrusion 121, which is positioned in the second section 221*b* of the guide groove 221, slides along the inclined surface 221*c* between the first section 221*a* and the second section 221*b* by the elastic restoring force, and as a result, the angle between the first and second fastener stringers 100 and 200 is increased.

Subsequently, when the guide protrusion 121 is inserted into the first section 221*a*, the first and second fastener stringers 100 and 200 are automatically separated in a state in which the first and second fastener stringers 100 and 200 are spread.

Therefore, the first and second fastener stringers 100 and 200 are automatically separated by the elastic means 400.

In the related art, an operation of moving the slider to a lower end of the fastener stringer and then separating the insertion pin from the slider is separately performed. However, in the present invention, only the operation of moving the slider 300 downward is performed to separate the slide fastener, and as a result, the convenience of the separating operation is greatly improved.

In this case, the leading portion 301 formed on the slider 300 prevents interference with the vertical movement of the second fastener stringer 200.

In addition, the insertion pin 210 has a fitting groove 211, and the fixing pin 110 has a fitting protrusion 111 inserted into the fitting groove 211. Edges of the fitting groove 211 and the fitting protrusion 111 are formed to have a rounded shape, such that the fitting groove 211 and the fitting protrusion 111 are smoothly coupled to each other.

Further, the insertion pin 210 has a guide plate 212 which is relatively thinner than other portions of the insertion pin 210 so as to be inserted into the channel 302 at the portion where the leading portion 301 is formed.

Furthermore, to ensure durability and strength with respect to bending of the insertion pin 210, a reinforcing member 213, which is relatively thicker than other portions of the insertion pin 210, is formed.

In addition, the insertion pin 210 has a fastening groove 214 formed to surround the core yarn 202 formed on the second fastener stringer 200.

Therefore, since the fastening groove 214 surrounds the core yarn 202 formed on the second fastener stringer 200, the insertion pin 210 is prevented from being separated from the second fastener stringer 200.

That is, coupling force of the fastened portion between the insertion pin 210 and the second fastener stringer 200, which receives a relatively large amount of stress when the first and second fastener stringers 100 and 200 are fastened or separated, is improved.

Meanwhile, the fastening groove 214 may be formed on the core yarn 202 by injection molding, and in this case, the fastening groove 214 may not be exposed to the outside.

Hereinafter, in the description of another exemplary embodiment of the slide fastener according to the present invention, only a difference from the first exemplary embodiment will be described, like reference numerals refer to constituent elements identical to those of the first exemplary embodiment, and a description thereof will be omitted.

Second Exemplary Embodiment

FIG. 6 is a cross-sectional front view illustrating a slide fastener according to a second exemplary embodiment of the present invention.

As illustrated in FIG. 6, in the slide fastener according to the second exemplary embodiment of the present invention, the fixing pin 110 has the first fastening member 120, and the insertion pin 210 has the second fastening member 220 which is coupled to the first fastening member 120 with directionality. The first fastening member 120 is formed in a cylinder shape, and the second fastening member 220 is accommodated in the first fastening member 120.

In this case, magnets 400' are provided on the first fastening member 120 and the second fastening member 220, respectively.

Therefore, an exact coupling position between the first fastening member 120 and the second fastening member 220 is guided by the magnets 400'.

Third Exemplary Embodiment

FIG. 7 is a cross-sectional plan view illustrating a slide fastener according to a third exemplary embodiment of the present invention.

As illustrated in FIG. 7, in the slide fastener according to the third exemplary embodiment of the present invention, the fixing pin 110 has the first fastening member 120, and the insertion pin 210 has the second fastening member 220 which is coupled to the first fastening member 120 with directionality. The first fastening member 120 is formed in a cylinder shape, and the second fastening member 220 is accommodated in the first fastening member 120.

In this case, a catching projection 221" is formed on the second fastening member 220 and inserted into the first fastening member 120, the first fastening member 120 has an omega shaped spring 400" corresponding to the catching projection 221", and a part of the omega shaped spring 400" is configured to protrude in a direction toward the slider 300.

In this case, when the spring, which protrudes to the outside of the first fastening member 120, is pushed by the slider 300, the engagement of the catching projection 121" by the spring 400" is released, such that the first and second fastening members 120 and 220 are separated from each other.

The first fastening member 120 and the spring 400" are configured such that a portion of the spring 400", which corresponds to the catching projection 221", is spread when a protruding portion of the spring 400" is pushed.

Fourth Exemplary Embodiment

FIGS. 9 and 10 are exploded perspective views of a slide fastener according to a fourth exemplary embodiment of the present invention.

As illustrated in FIGS. 9 and 10, in the slide fastener according to the fourth exemplary embodiment of the present invention, a first support protrusion 215 is formed on one of the fixing pin 110 and the insertion pin 210, and a first support groove 115, which is coupled to the first support protrusion 215, is formed in the other of the fixing pin 110 and the insertion pin 210, which does not has the first support protrusion 215.

That is, horizontal coupling force between the fixing pin 110 and the insertion pin 210 is improved by coupling the first support groove 115 and the first support protrusion 215.

In addition, a second support protrusion 116 is formed on one of the fixing pin 110 and the insertion pin 210, and a second support groove 216, which is coupled to the second support protrusion 116, is formed in the other of the fixing pin 110 and the insertion pin 210, which does not have the second support protrusion 116.

That is, horizontal coupling force between the fixing pin 110 and the insertion pin 210 is improved by coupling the second support groove 116 and the second support protrusion 216.

Meanwhile, vertical coupling force between the fixing pin 110 and the insertion pin 210 is also improved since the second support groove 216 is formed to vertically surround the second support protrusion 116.

Lastly, the fixing pin 110 has a stopper insertion groove 117 into which a stopper of the slider 300 is inserted, and as a result, the slider 300 is fixed to the fixing pin 110 without being moved.

While the exemplary embodiments of the present invention have been described in detail above, the technical scope of the present invention is not limited to the exemplary embodiments, and the technical scope of the present invention should be defined by the claims. In this case, it should be noted that those skilled in the art may variously modify and change the exemplary embodiments without departing from the scope of the present invention.

The invention claimed is:

1. A slide fastener comprising:

a first fastener stringer which comprises a fixing pin;

a second fastener stringer which comprises an insertion pin; and a slider which couples or separates the first and second fastener stringers, wherein a first fastening member is provided on the fixing pin, and a second fastening member is provided on the insertion pin and coupled to the first fastening member, wherein a guide protrusion is formed on one of the first fastening member and the second fastening member, and a guide groove, which corresponds to the guide protrusion, is formed in the other of the first fastening member and the second fastening member, which does not have the guide protrusion, wherein the guide protrusion moves along the guide groove and the second fastener stringer separated from the slider is inserted into the slider when the first fastener stringer and the second fastener stringer are coupled in a vertical direction; and wherein the guide groove is divided into a first section, a second section which is wider than the first section, and an inclined surface between the first section and the second section.

2. The slide fastener of claim 1, wherein a guide surface, which guides the insertion of the guide protrusion, is formed in an inlet of the first section.

3. The slide fastener of claim 1, wherein the second fastener stringer has an insertion member, and the slider has a channel into which the insertion member is inserted and a leading portion which is cut out to guide the insertion member to the channel.

4. The slide fastener of claim 3, wherein a distance between the insertion member and the second fastening member is equal to or greater than a length of the channel.

5. A slide fastener comprising:

a first fastener stringer which comprises a fixing pin;

a second fastener stringer which comprises an insertion pin;

a slider which couples or separates the first and second fastener stringers; and an elastic means which automatically separates the second fastening member from the first fastening member;

wherein a first fastening member is provided on the fixing pin, and a second fastening member is provided on the insertion pin and coupled to the first fastening member, wherein a guide protrusion is formed on one of the first fastening member and the second fastening member, and a guide groove, which corresponds to the guide protrusion, is formed in the other of the first fastening member and the second fastening member, which does not have the guide protrusion, and wherein the guide protrusion moves along the guide groove and the second fastener stringer separated from the slider is inserted into the slider when the first fastener stringer and the second fastener stringer are coupled in a vertical direction.

6. The slide fastener of claim 5, wherein the elastic means includes:

an accommodating groove formed in the second fastening member;

a push rod inserted into the accommodating groove; and a spring interposed between the accommodating groove and the push rod.

7. The slide fastener of claim 1, wherein the insertion pin has a fitting groove and the fixing pin has a fitting protrusion inserted into the fitting groove.

8. The slide fastener of claim 1, wherein at least one of the first and second fastening members includes a magnet.

9. A slide fastener comprising:

a first fastener stringer which comprises a fixing pin;

a second fastener stringer which comprises an insertion pin; and a slider which couples or separates the first and second fastener stringers, wherein a first fastening member is provided on the fixing pin, and a second fastening member is provided on the insertion pin and coupled to the first fastening member, wherein a guide protrusion is formed on one of the first fastening member and the second fastening member, and a guide groove, which corresponds to the guide protrusion, is formed in the other of the first fastening member and the second fastening member, which does not have the guide protrusion, wherein the guide protrusion moves along the guide groove and the second fastener stringer separated from the slider is inserted into the slider when the first fastener stringer and the second fastener stringer are coupled in a vertical direction;

wherein the guide groove is divided into a first section, a second section which is wider than the first section, and an inclined surface between the first section and the second section; and wherein the second fastening member has a catching projection inserted into the first fastening member, the first fastening member has an omega shaped spring corresponding to the catching projection, and a part of the omega shaped spring protrudes toward the slider.

10. A slide fastener comprising:

a first fastener stringer which comprises a fixing pin;

a second fastener stringer which comprises an insertion pin; and a slider which couples or separates the first and second fastener stringers, wherein a first fastening member is provided on the fixing pin, and a second fastening member is provided on the insertion pin and coupled to the first fastening member, wherein a guide protrusion is formed on one of the first fastening member and the second fastening member, and a guide groove, which corresponds to the guide protrusion, is formed in the other of the first fastening member and the second fastening member, which does not have the guide protrusion, wherein the guide protrusion moves along the guide groove and the second fastener stringer separated from the slider is inserted into the slider when the first fastener stringer and the second fastener stringer are coupled in a vertical direction;

wherein the guide groove is divided into a first section, a second section which is wider than the first section, and an inclined surface between the first section and the second section; and wherein the insertion pin has a fastening groove that surrounds a core yarn formed on the second fastener stringer.

* * * * *